US010147260B2

(12) United States Patent
Yamamoto et al.

(10) Patent No.: US 10,147,260 B2
(45) Date of Patent: Dec. 4, 2018

(54) IMAGE PROCESSING DEVICE, IMAGE PROCESSING METHOD, AND PROGRAM FOR CAPTURING IMAGES PRINTED WITH VARIOUS INKS

(71) Applicant: Seiko Epson Corporation, Tokyo (JP)

(72) Inventors: Takayuki Yamamoto, Matsumoto (JP); Morimichi Mizuno, Azumino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/928,731

(22) Filed: Oct. 30, 2015

(65) Prior Publication Data

US 2016/0133079 A1 May 12, 2016

(30) Foreign Application Priority Data

Nov. 10, 2014 (JP) ..... 2014-227810

(51) Int. Cl.
*G07D 7/12* (2016.01)
*G07D 7/20* (2016.01)

(52) U.S. Cl.
CPC ..... *G07D 7/12* (2013.01); *G07D 7/2016* (2013.01)

(58) Field of Classification Search
None
See application file for complete search history.

(56) References Cited

U.S. PATENT DOCUMENTS 5,589,276 A * 12/1996 Roth ..... B41M 5/38207 427/146
6,507,660 B1 * 1/2003 Wirtz ..... G06K 9/6204 382/103
2005/0156048 A1 * 7/2005 Reed ..... G06T 1/0042 235/491
2006/0152581 A1 7/2006 Fukuyama
2006/0269159 A1 * 11/2006 Kim ..... G06T 5/50 382/256

(Continued)

FOREIGN PATENT DOCUMENTS

JP 11-086074 3/1999
JP 2006-192009 A 7/2006

(Continued)

*Primary Examiner* — Michelle M Entezari
(74) *Attorney, Agent, or Firm* — Nutter McClennen & Fish LLP

(57) ABSTRACT

An image processing method corrects an image acquired from a medium exposed to ultraviolet light and makes parts printed with UV ink easily recognizable. A control device acquires a first image captured by an image sensor from a check exposed to visible light, and acquires a second image captured by the image sensor from the check when exposed to ultraviolet light. The control device generates a first edge image by applying an image processing filter that extracts edges in the first image, and generates a second edge image by applying an image processing filter that extracts edges in the second image. The control device then finds common edges where a first edge extracted in the first edge image and a second edge extracted in the second edge match each other, removes the common edges from the second edge image, and outputs a second image from which the common edges are removed.

5 Claims, 6 Drawing Sheets

(56) References Cited

U.S. PATENT DOCUMENTS

2007/0244815 A1* 10/2007 Hawkins ..... G06Q 20/04 705/45
2007/0253593 A1* 11/2007 Simske ..... G06T 1/0071 382/100
2008/0181451 A1* 7/2008 Simske ..... G06K 9/2054 382/101
2009/0028461 A1 1/2009 Wieringa et al.
2009/0080735 A1* 3/2009 Chapman ..... G06T 7/0004 382/128
2011/0110597 A1* 5/2011 Abe ..... G06K 9/6203 382/199
2012/0133121 A1* 5/2012 Bleikolm ..... B42D 25/29 283/67
2013/0077136 A1 3/2013 Motoyama
2013/0169677 A1* 7/2013 Rosset ..... B41M 3/148 345/629
2013/0336569 A1* 12/2013 Kinoshita ..... G06K 7/1404 382/139
2014/0112543 A1* 4/2014 Nakayama ..... G06K 9/00791 382/104
2014/0244485 A1* 8/2014 Keenan ..... G06Q 20/26 705/39
2016/0063460 A1* 3/2016 Benton ..... G06Q 20/102 705/40

FOREIGN PATENT DOCUMENTS

JP 2007-522869 A 8/2007
JP 2007-241372 A 9/2007
JP 2012-182626 A 9/2012
JP 2013-070225 A 4/2013

* cited by examiner

IMAGE PROCESSING DEVICE, IMAGE PROCESSING METHOD, AND PROGRAM FOR CAPTURING IMAGES PRINTED WITH VARIOUS INKS

BACKGROUND

1. Technical Field

The present invention relates to an image processing device, an image processing method and a program for capturing an image printed with UV ink that fluoresces when exposed to ultraviolet light.

2. Related Art

When a check having a security image printed with ink (referred to below as UV ink) that fluoresces when exposed to ultraviolet light is presented to a bank or other financial institution, the check is authenticated before processing the check for payment, for example. The authentication process acquires an image of the check with a check processing device having an image sensor including a light source that exposes the check to ultraviolet light, and verifies the security image. An example of a check processing device that can be used in such an authentication process is described in JP-A-2013-70225.

The image acquired by reading the check exposed to ultraviolet light with an image sensor includes both the reflection (ultraviolet light) of the scanning beam reflected by the surface of the check, and the fluorescence produced by the UV ink forming the security image. More specifically, the acquired image includes both an image of the fluorescence from the UV ink and an image of the reflected light. Identifying the part printed with UV ink based on the acquired image can therefore be difficult.

SUMMARY

An image processing device, an image processing method, and a program according to the invention correct the image acquired from a medium exposed to ultraviolet light and make identifying the part printed with UV ink easy.

An image processing device according to the invention has an image acquisition unit that drives an image sensor, acquires a first image by reading a surface of a medium exposed to a visible first light, and acquires a second image by reading a surface of the medium exposed to an ultraviolet second light; an edge image generating unit that applies an edge-extracting image processing filter to the first image and generates a first edge image, and applies the image processing filter to the second image and generates a second edge image; and a common-edge-removed second image generating unit that detects common edge parts where a first edge extracted in the first edge image and a second edge extracted in the second edge image are at corresponding positions, removes the common edge parts from the second edge image, and generates a common-edge-removed second image.

The second image acquired when the image sensor scans the surface of the medium exposed to the second light containing ultraviolet light includes images of both the reflection of the ultraviolet light and fluorescence produced by UV ink. As a result, when content such as lines or text is printed with normal ink (not UV ink) on the medium, images of the lines and text are captured in addition to the parts printed with UV ink. Both the edges of the images printed with UV ink and the edges of the images of the lines and text printed with normal ink are therefore extracted in the second edge image that is acquired by applying an edge-extracting image processing filter to the second image.

The edges of the lines and text printed with normal ink are extracted in the first edge image, which is acquired by applying an image processing filter that extracts edges to the first image capturing the surface of the medium exposed to the visible first light. Therefore, an image of the extracted edges of the part printed with UV ink remains in the common-edge-removed second image, which is created by removing from the second edge image the common edge parts where the first edges extracted in the first edge image and the second edges extracted in the second edge image match. The part printed with UV ink can therefore be easily identified in the common-edge-removed second image.

Preferably, the common-edge-removed second image generating unit detects the common edge parts based on first vector information of the first edge and second vector information of the second edge.

In this case, for example, a second edge part of a second edge where the strength component (edge strength) of the second vector information is less than or equal to than a first strength threshold may be detected as a common edge part; a second edge part of a second edge where the strength component (edge strength) of the second vector information is less than the first strength threshold, and a first edge part of a first edge where the strength component (edge strength) of the first vector information is greater than or equal to a second strength threshold, can be detected to be common edge parts if the difference between the directional component of the first vector information and the directional component of the second vector information is within a predetermined angle range.

An image processing device according to another aspect of the invention preferably uses a Sobel filter as the image processing filter for generating images of the edges extracted from the first image and second image.

Another aspect of the invention is an image processing method including: driving an image sensor, acquiring a first image by reading a surface of a medium exposed to a visible first light, and acquiring a second image by reading a surface of the medium exposed to an ultraviolet second light; generating a first edge image by applying an edge-extracting image processing filter to the first image, and generating a second edge image by applying the image processing filter to the second image; and generating a common-edge-removed second image by detecting common edge parts where a first edge extracted in the first edge image and a second edge extracted in the second edge image are at corresponding positions, and removing the common edge parts from the second edge image.

In the second edge image acquired by applying an image processing filter that extracts edges to a second image that captures the surface of a medium exposed to a second light containing ultraviolet light, both the edges of the images printed with UV ink and the edges of the images of the lines and text printed with normal ink are extracted.

The edges of the lines and text printed with normal ink are extracted in the first edge image, which is acquired by applying an image processing filter that extracts edges to the first image capturing the surface of the medium exposed to the visible first light.

Therefore, an image of the extracted edges of the part printed with UV ink remains in the common-edge-removed second image, which is created by removing from the second edge image the common edge parts where the first edges extracted in the first edge image and the second edges extracted in the second edge image match. The part printed with UV ink can therefore be easily identified in the second image from which common edges are removed.

An image processing method according to another aspect of the invention preferably detects the common edge parts based on first vector information of the first edge and second vector information of the second edge.

An image processing method according to another aspect of the invention preferably uses a Sobel filter as the image processing filter for generating images of the edges extracted from the first image and second image.

Another aspect of the invention is a program that operates on a control device that controls driving an image sensor, the program causing the control device to function as: an image acquisition unit that drives an image sensor, acquires a first image by reading a surface of a medium exposed to a visible first light, and acquires a second image by reading a surface of the medium exposed to an ultraviolet second light; an edge image generating unit that applies an edge-extracting image processing filter to the first image and generates a first edge image, and applies the image processing filter to the second image and generates a second edge image; and a common-edge-removed second image generating unit that detects common edge parts where a first edge extracted in the first edge image and a second edge extracted in the second edge image are at corresponding positions, removes the common edge parts from the second edge image, and generates a common-edge-removed second image.

In the second edge image acquired by applying an image processing filter that extracts edges to a second image that captures the surface of a medium exposed to a second light containing ultraviolet light, both the edges of the images printed with UV ink and the edges of the images of the lines and text printed with normal ink are extracted.

The edges of the lines and text printed with normal ink are extracted in the first edge image, which is acquired by applying an image processing filter that extracts edges to the first image capturing the surface of the medium exposed to the visible first light.

Therefore, an image of the extracted edges of the part printed with UV ink remains in the common-edge-removed second image, which is created by removing from the second edge image the common edge parts where the first edges extracted in the first edge image and the second edges extracted in the second edge image match. The part printed with UV ink can therefore be easily identified in the second image from which common edges are removed.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a check processing system according to the present invention is described below with reference to the accompanying figures.

Check Processing System

Figure 1A:
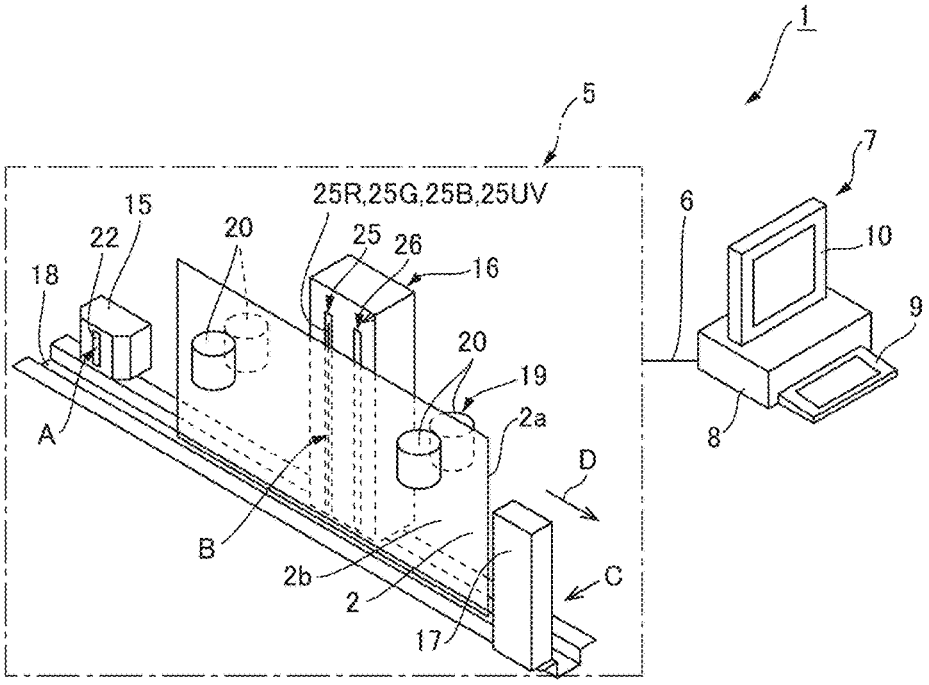
FIGS. 1A and 1B illustrate a check processing system according to the invention.
Figure 1B:
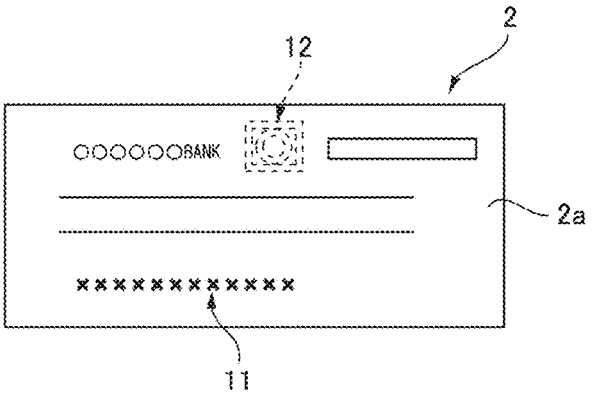

FIG. 1A illustrates a check processing system, and FIG. 1B shows an example of a check. The check processing system 1 executes a payment process using a check 2. As shown in FIG. 1A, the check processing system 1 includes a check processing device 5, and a control device 7 communicatively connected to the check processing device 5 through a cable 6, for example. The control device 7 includes a main unit 8, and an input device 9 and display 10 connected to the main unit 8. The main unit 8 is a computer.

A line and the name of the financial institution, for example, are printed in normal ink on the face 2*a* of the check 2 presented to a financial institution as shown in FIG. 1B. Magnetic ink characters 11 expressing the customer account number and other information are also printed in magnetic ink on the face 2*a* of the check 2. A security image 12 that fluoresces when exposed to UV light is also printed on the face 2*a* of the check 2 using UV ink.

As shown in FIG. 1A, the check processing device 5 has a magnetic sensor 15, an image sensor 16, and a printhead 17. The check processing device 5 also has a conveyance path 18 that passes the magnetic reading position A of the magnetic sensor 15, the image reading position B of the image sensor 16, and the printing position C of the printhead 17. The 5 also has a conveyance mechanism 19 that conveys a check 2 inserted to the conveyance path 18 past the magnetic reading position A, image reading position B, and printing position C. The conveyance mechanism 19 includes a conveyance roller pair 20 that holds and conveys the check 2 inserted to the conveyance path 18, and a conveyance motor (see FIG. 2) that drives the conveyance roller pair 20.

The magnetic sensor 15 is disposed with the magnetic reading surface 22 facing the conveyance path 18. The magnetic sensor 15 reads the magnetic ink characters 11 from the check 2 passing the magnetic reading position A.

The image sensor 16 is a CIS (contact image sensor) module. The image sensor 16 emits light to the check 2 passing the image reading position B and captures the reflection or fluorescence from the check 2. The image sensor 16 is disposed with the photoemitter unit 25 and reading unit (imaging element) 26 facing the conveyance path 18.

The photoemitter unit 25 is disposed on a vertical line perpendicular to the conveyance direction D. The light elements of the photoemitter unit 25 include a plurality of red photoemission elements 25R that emit red light, a plurality of green photoemission elements 25G that emit green light, a plurality of blue photoemission elements 25B that emit blue light, and a plurality of UV photoemission elements 25UV that emit ultraviolet light. The multiple photoemission elements 25R, 25G, 25B, and 25UV that emit respective colors of light are disposed in vertical lines.

The reading unit 26 is displayed in a vertical line along the photoemitter unit 25. The reading unit 26 is an imaging element such as a CMOS sensor. The reading unit 26 (imaging element) reads the check 2 passing the image reading position B sequentially one vertical line at a time timed to emission of the reading beams to the check 2.

The printhead 17 is disposed on the opposite side of the conveyance path 18 as the magnetic sensor 15 and image sensor 16. The printhead 17 is also disposed with the printing surface facing the conveyance path 18. The printhead 17 prints an endorsement on the back 2*b* of the check 2 passing the printing position C.

The check processing device 5 conveys checks 2 through the conveyance path 18 by means of the conveyance mechanism 19. The check processing device 5 reads the magnetic ink characters 11 from the check 2 passing the magnetic reading position A with the magnetic sensor 15 and acquires magnetic information. The check processing device 5 then sends the read magnetic information to the control device 7. The check processing device 5 also reads the face 2*a* of the check 2 passing the image reading position B by means of the image sensor 16, and sequentially sends the scanning information to the control device 7. The check processing device 5 also controls the printhead 17 based on print commands from the control device 7, and prints an endorsement on the check 2 used in the payment process.

The control device 7 receives the magnetic information acquired by the check processing device 5, and executes a payment process based on the input information input from the input device 9.

Figure 3A:
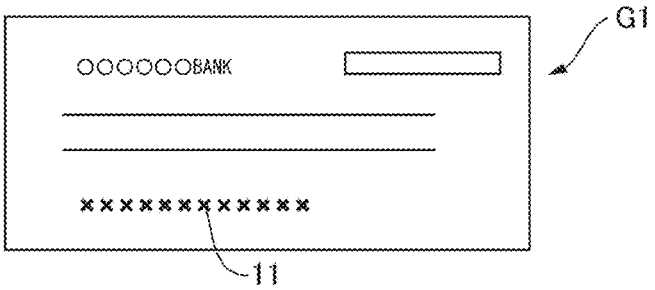
FIGS. 3A and 3B illustrate a first image and a second image of a check.
Figure 3B:
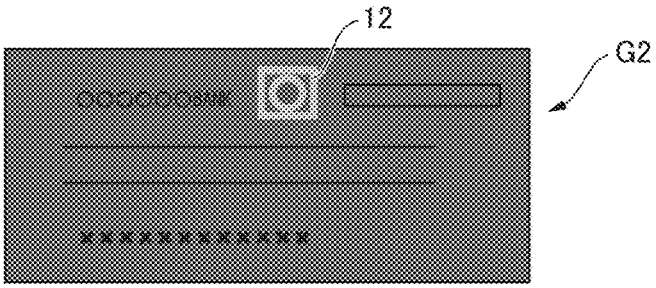

Based on the scanning information (output from the image sensor 16) sequentially sent from the check processing device 5, the control device 7 acquires a first image G1 (first image, see FIG. 3A) and a second image G2 (second image, see FIG. 3B). The first image G1 is a gray scale (composite gray) image captured when the check 2 is exposed to visible light (red light, blue light, green light), and the second image G2 is a gray scale image captured when the check 2 is exposed to ultraviolet light. The first image G1 and second image G2 are composed of pixels corresponding to the resolution of the image sensor 16.

The control device 7 also generates a common-edge-removed second image I2. The control device 7 also stores and saves the first image G1 and the common-edge-removed second image I2 a proof of the transaction process. When the transaction process ends, the control device 7 sends a print command to the check processing device 5 and drives the check processing device 5 to print an endorsement on the check 2.

Control System of the Check Processing Device

Figure 2:
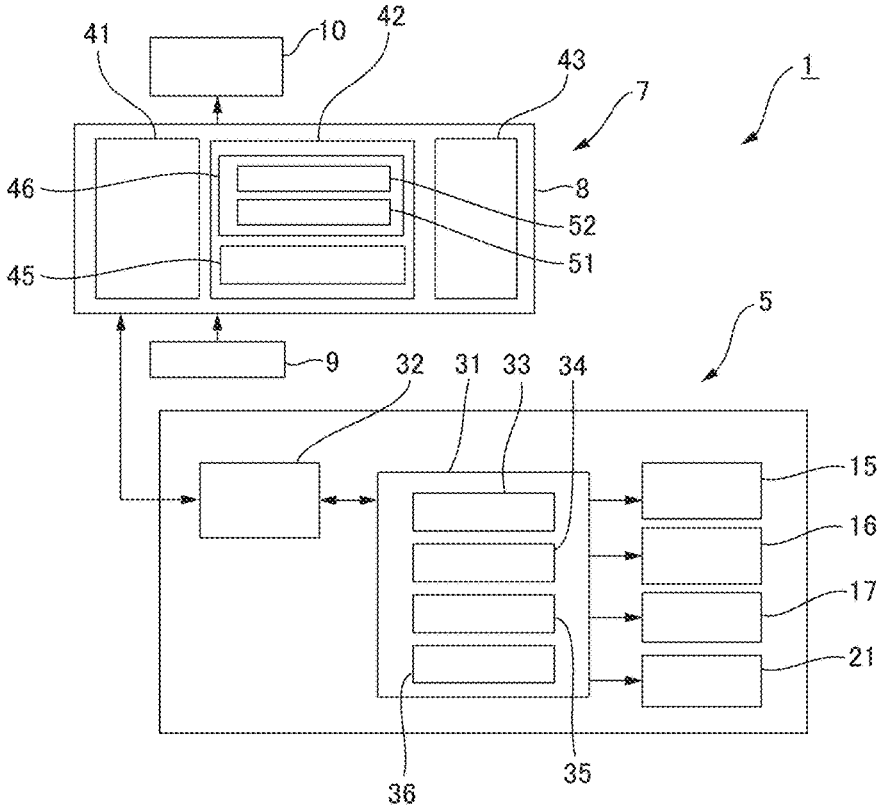
FIG. 2 is a block diagram of the control system of the check processing system.
Figure 6:
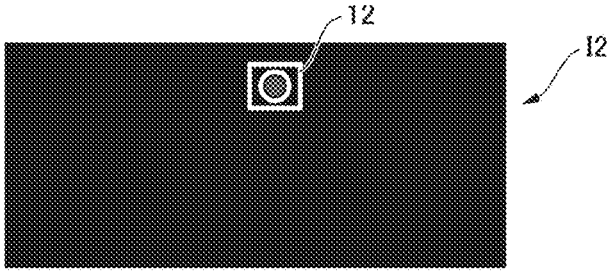
FIG. 6 illustrates a common-edge-removed second image.

FIG. 2 is a block diagram illustrating the control system of the check processing system 1. FIG. 3 illustrates the first image G1 and second image G2. FIG. 4 illustrates a first edge image H1 and a second edge image H2. FIG. 6 illustrates the common-edge-removed second image I2.

As shown in FIG. 2, the control system of the check processing device 5 is configured around a control unit 31 comprising a CPU. A communication unit 32 with a communication interface for communicating with the control device 7 is connected to the control unit 31. The magnetic sensor 15, image sensor 16, printhead 17, and conveyance motor 21 are also connected to the control unit 31 through drivers not shown.

A control program operates on the control unit 31. The control program causes the control unit 31 to function as a conveyance control unit 33, magnetic information acquisition unit 34, image scanning unit 35, and print unit 36. The control unit 31 therefore includes a conveyance control unit 33, magnetic information acquisition unit 34, image scanning unit 35 and print unit 36.

The conveyance control unit 33 controls driving the conveyance motor 21 to convey a check 2 through the conveyance path 18.

The magnetic information acquisition unit 34 drives the magnetic sensor 15 to acquire magnetic reading information (detection signal) from the magnetic ink characters 11 of the check 2 passing the magnetic reading position A. Based on the magnetic reading information, the magnetic information acquisition unit 34 recognizes the magnetic ink characters 11. Recognition of the magnetic ink characters 11 is done by comparing the magnetic reading information output from the magnetic sensor 15 with the previously stored signal waveform patterns of the magnetic ink characters 11. The magnetic information acquisition unit 34 acquires the result of recognizing the magnetic ink characters 11 as magnetic information. When the magnetic information is acquired, the magnetic information acquisition unit 34 outputs the magnetic information to the control device 7.

The image scanning unit 35 drives the image sensor 16 to read the face 2*a* of the check 2 passing the image reading position B.

When scanning the face 2*a* of the check 2 with the image sensor 16, the image scanning unit 35 sequentially emits red light, green light, blue light, and ultraviolet light from the photoemitter unit 25 to the face 2*a* of the check 2 at the image reading position B while advancing the check 2 the distance of one line, which is determined by the scanning resolution. Each time the check 2 is advanced the distance of one line, the image scanning unit 35 controls the reading unit 26 to sequentially capture an image of one line of the check 2 when exposed to red light, an image of one line of the check 2 when exposed to blue light, an image of one line of the check 2 when exposed to green light, and an image of one line of the check 2 when exposed to ultraviolet light. The image scanning unit 35 then sequentially sends the scanning information output from the reading unit 26 when red light is emitted, the scanning information output from the reading unit 26 when blue light is emitted, the scanning information output from the reading unit 26 when green light is emitted, and the scanning information output from the reading unit 26 when ultraviolet light is emitted to the control device 7.

The print unit 36 drives the printhead 17 based on print commands output from the control device 7 to print on the back 2*b* of the check 2 passing the printing position C.

As shown in FIG. 2, the control device 7 has a check processing device control unit 41, an image processing unit 42, and a payment processing unit 43. The control device 7 functions as the check processing device control unit 41, image processing unit 42, and payment processing unit 43 as a result of a program running on the main unit 8.

The check processing device control unit 41 sends a start processing command that starts the check scanning operation to the check processing device 5. The check scanning operation is an operation that conveys the check 2 through the conveyance path 18 and sends the captured magnetic information and scanning information to the control device 7.

The image processing unit 42 has an image acquisition unit 45 that acquires the first image G1 based on the scanning information output from the reading unit 26 while visible light (red light, green light, blue light) is emitted, and acquires the second image G2 based on the scanning information output from the reading unit 26 while ultraviolet light is emitted. The image processing unit 42 also has a second image processing unit 46 that image processes the second image G2.

The image acquisition unit 45 acquires the first image G1 based on the scanning information output from the reading unit 26 while red light is emitted, the scanning information output from the reading unit 26 while blue light is emitted, and the scanning information output from the reading unit 26 while green light is emitted. An example of the first image G1 acquired by the image acquisition unit 45 is shown in FIG. 3A. Because the first image G1 is displayed on the display 10, brightness is represented by luminance values. As described above, the first image G1 is a gray scale image, there are 256 luminance values representing luminance (brightness) with a luminance value of 0 being the darkest (black) and a luminance value of 255 being the brightest (white).

The image acquisition unit 45 acquires the second image G2 based on the scanning information output from the reading unit 26 while ultraviolet light is emitted. A second image G2 acquired by the image acquisition unit 45 is shown in FIG. 3B. In the second image G2, areas imaging the reflection (ultraviolet rays) of the scanning beam reflected from the surface of the check 2 are dark (luminance is low), and areas imaging the fluorescence produced by the portions printed with UV ink are light (luminance is high).

The second image processing unit 46 includes a edge image generating unit 51 and a common-edge-removed second image generating unit 52.

The edge image generating unit 51 generates a first edge image H1 by applying an image processing filter that extracts edges to the first image G1. The edge image generating unit 51 also generates a second edge image H2 by applying an image processing filter to the second image G2. The image processing filter in this example is a Sobel filter. A differential filter or Prewitt filter, for example, may also be used as the image processing filter for extracting edges.

Figure 4A:
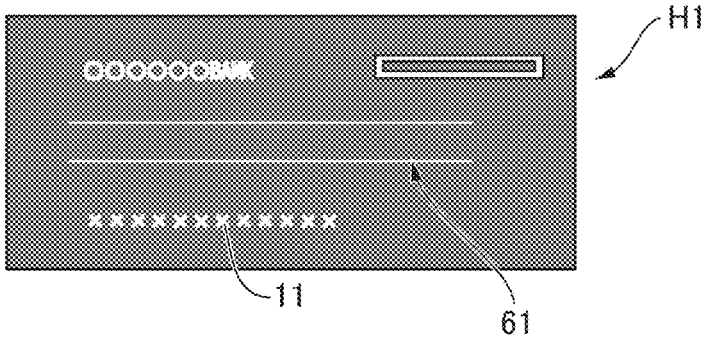
FIGS. 4A and 4B illustrate a first edge image and a second edge image.

An example of the first edge image H1 acquired by applying a Sobel filter to the first image G1 is shown in FIG. 4A. A first edge 61 extracted by the Sobel filter is contained in the first edge image H1. The first edge image H1 can be expressed by equation (1) below where $I_{CMP}$ (x, y) is the first image G1.

$$\overrightarrow{E_{CMP}}(x, y) = \begin{pmatrix} I_{CMP}(x+1, y-1) + 2 \times I_{CMP}(x+1, y) + \\ I_{CMP}(x+1, y+1) - I_{CMP}(x-1, y-1) - \\ 2 \times I_{CMP}(x-1, y) - I_{CMP}(x-1, y+1) \\ I_{CMP}(x-1, y+1) + 2 \times I_{CMP}(x, y+1) + \\ I_{CMP}(x+1, y+1) - I_{CMP}(x-1, y-1) - \\ 2 \times I_{CMP}(x, y-1) - I_{CMP}(x+1, y-1) \end{pmatrix} \quad \text{Equation 1}$$

Figure 4B:
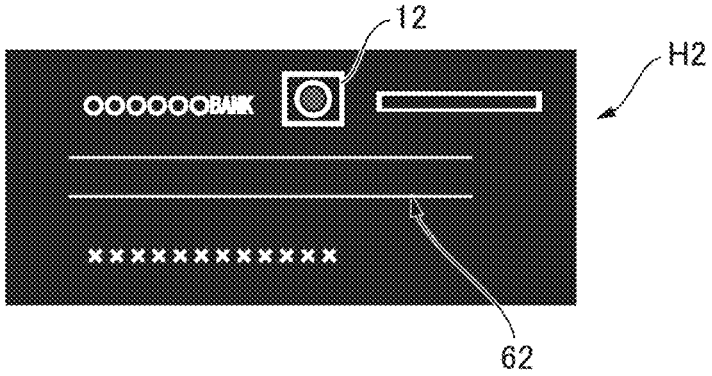

An example of the second edge image H2 acquired by applying a Sobel filter to the second image G2 is shown in FIG. 4B. A second edge 62 extracted by the Sobel filter is contained in the second edge image H2. The second edge image H2 can be expressed by equation (2) below where $I_{UV}$ (x, y) is the second image G2.

$$\overrightarrow{E_{UV}}(x, y) = \begin{pmatrix} I_{UV}(x+1, y-1) + 2 \times I_{UV}(x+1, y) + \\ I_{UV}(x+1, y+1) - I_{UV}(x-1, y-1) - \\ 2 \times I_{UV}(x-1, y) - I_{UV}(x-1, y+1) \\ I_{UV}(x-1, y+1) + 2 \times I_{UV}(x, y+1) + \\ I_{UV}(x+1, y+1) - I_{UV}(x-1, y-1) - \\ 2 \times I_{UV}(x, y-1) - I_{UV}(x+1, y-1) \end{pmatrix} \quad \text{Equation 2}$$

The common-edge-removed second image generating unit 52 detects mutually corresponding common edge parts in the first edges 61 extracted in the first edge image H1 and the second edges 62 extracted in the second edge image H2, and generates a common-edge-removed second image I2 by removing these common edge parts from the second edge image H2. The common edge parts are detected based on first vector information, which is vector information of the first edges 61, and second vector information, which is vector information of the second edges 62.

The first vector information represents the edge strength and direction of a first edge 61 in the pixels of the first edge image H1. The edge strength of a first edge 61 in the pixels of the first edge image H1 can be expressed by equation 3 below. The direction of a first edge 61 in the pixels of the first edge image H1 is the direction in which the change in brightness (luminance) between adjacent pixels increases.

$$|\overrightarrow{E_{CMP}}(x, y)| \quad \text{Equation 3}$$

The second vector information represents the edge strength and direction of a second edge 62 in the pixels of the second edge image H2. The edge strength of a second edge 62 in the pixels of the second edge image H2 can be expressed by equation 4 below. The direction of a second edge 62 in the pixels of the second edge image H2 is the direction in which the change in brightness (luminance) between adjacent pixels increases.

$$|\overrightarrow{E_{UV}}(x, y)| \quad \text{Equation 4}$$

Figure 5:
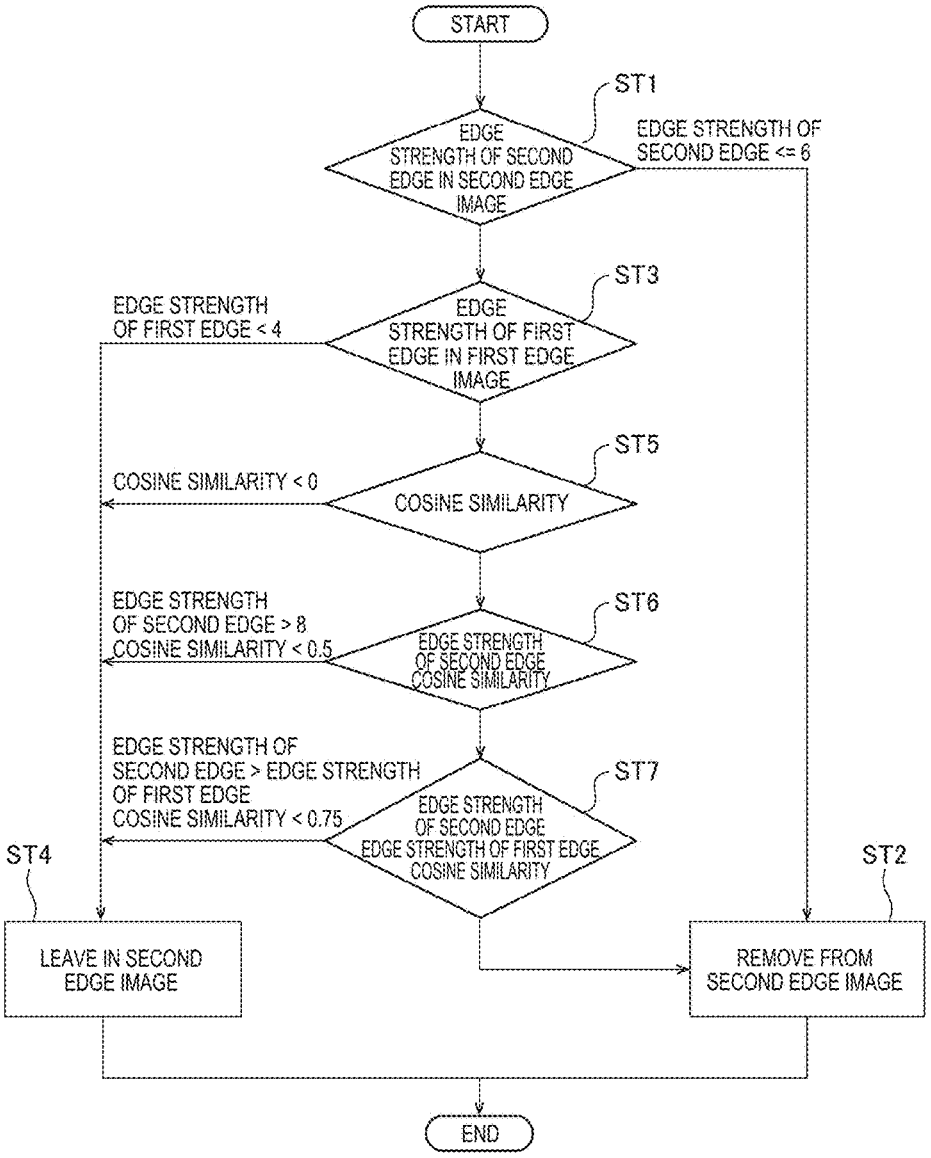
FIG. 5 is a flow chart of the common edge removal operation.

FIG. 5 is a flow chart of the operation whereby the common-edge-removed second image generating unit 52 generates the common-edge-removed second image I2.

The common-edge-removed second image generating unit 52 first removes the edge portions of the second edges 62 formed by pixels in the second edge image H2 where the edge strength of the second edge 62 satisfying equation 4 is less than or equal to a first strength threshold from the second edge image H2 (step ST1, step ST2).

More specifically, the luminance of pixels in image areas that capture the fluorescence produced by UV ink is high relative to the fluorescence of pixels in other adjacent parts of the image. Because the difference between the luminance of pixels imaging fluorescence and the luminance of pixels in adjacent areas imaging reflectance is great, the edge strength of a second edge 62 formed by pixels imaging fluorescence is high. Pixels in the second edge image H2 with relatively low edge strength can therefore be considered part of a common edge (a part not including an image printed with UV ink) and removed from the second edge image H2. Edge parts are removed from the second edge image H2 by setting the luminance of the pixels in that edge area to 0 (black). In this example, the first strength threshold is 6.

Next, a process that finds pixels in the second edge image H2 corresponding to (at the same coordinate position as) pixels in the first edge image H1 where the edge strength of the first edge 61 defined in equation 3 is less than or equal to a predefined second strength threshold and leaves those pixels unchanged in the second edge image H2 is executed (step ST3, step ST4). More specifically, pixels in the first edge image H1 with relatively low edge strength form a mutually corresponding common edge part in the first edge 61 and second edge 62, and the pixels of the second edge 62 corresponding to these pixels are left in the second edge image H2. In other words, pixels in the first edge image H1 with relatively high edge strength may form part of mutually corresponding common edge portion of the first edge 61 and second edge 62, and are reserved in step ST3. Note that the process that leaves the pixels of the second edge 62 in the second edge image H2 is a process that leaves the luminance of those pixels unchanged.

Next, the cosine similarity C(x,y) of the pixels of the second edge image H2 that are not processed and the corresponding pixels of the first edge image H1 is calculated. The cosine similarity C(x,y) represents the similarity of the direction of the second edge and the direction of the first edge between the pixels of the second edge image H2 and the pixels of the first edge image H1 corresponding to those pixels of the second edge image H2. Corresponding pixels in the first edge image H1 and the second edge image H2 are pixels with the same coordinates.

The cosine similarity C(x, y) can be expressed by equation 5 below. Note that the cosine similarity C(x,y) is 1 when the direction of the second edge and the direction of the first edge match. When the direction of the second edge and the direction of the first edge are opposite (differ 180 degrees), the cosine similarity C(x,y) is −1.

$$C(x, y) = \frac{\overrightarrow{E_{CMP}}(x, y) \cdot \overrightarrow{E_{UV}}(x, y)}{\left|\overrightarrow{E_{CMP}}(x, y)\right|\left|\overrightarrow{E_{UV}}(x, y)\right|} \quad \text{Equation 5}$$

Pixels of the second edge image H2 where the cosine similarity C(x,y) is determined to be less than a preset first similarity threshold are determined to not be pixels that are part of a common edge and are left unchanged in the second edge image H2 (step ST5, step ST4). In this example, the first similarity threshold is 0. If the cosine similarity C(x,y) is less than 0, the direction of the second edge 62 in the pixels of the second edge image H2 and the direction of the first edge 61 in corresponding pixels of the first edge image H1 differs by an angle greater than 90 degrees.

Next, a process that determines pixels of the second edge image H2 that have still not been processed are not pixels that are part of a common edge if the edge strength is greater than a preset third strength threshold and the cosine similarity C(x, y) is less than a preset second similarity threshold, and leaves those pixels unchanged in the second edge image H2, executes (step ST6, step ST4).

The third strength threshold is greater than the first strength threshold, and in this example the third strength threshold is 8. The second similarity threshold is greater than the first similarity threshold, and in this example the second similarity threshold is 0.5.

Therefore, if the edge strength of a pixel in the second edge image H2 is relatively high, and the direction of the second edge 62 at that pixel and the direction of the first edge 61 at the corresponding pixel in the first edge image H1 differ by an angle greater than 45 degrees, the process of step ST6 and step ST4 leaves that pixel unchanged in the second edge image H2.

Next, a process that determines pixels of the second edge image H2 that have still not been processed are not pixels that are part of a common edge if the edge strength of the pixel is greater than the edge strength of the corresponding pixel in the first edge image H1 and the cosine similarity C(x, y) is less than a preset third similarity threshold, and leaves those pixels unchanged in the second edge image H2, executes (step ST7, step ST4).

The third similarity threshold is greater than the second similarity threshold, and in this example the third similarity threshold is 0.75.

Therefore, if the edge strength of a pixel in the second edge image H2 is greater than the edge strength of the corresponding pixel in the first edge image H1, and the direction of the second edge 62 at that pixel and the direction of the first edge 61 at the corresponding pixel in the first edge image H1 differ by an angle greater than 22.5 degrees, the process of step ST7 and step ST4 leaves that pixel unchanged in the second edge image H2.

Next, pixels in the second edge image H2 that have still not been processed are determined to be part of a common edge and are therefore removed from the second edge image H2 (step ST2). This results in a common-edge-removed second image I2 such as shown in FIG. 6. Only the extracted edges of the security image 12 (an image of the part printed with UV ink) appears in the common-edge-removed second image I2.

The payment processing unit 43 executes the payment process based on magnetic information including the account number received from the check processing device 5, and input information such as the amount input to the control device 7 through the input device 9. The payment processing unit 43 also displays the first image G1 and the common-edge-removed second image I2 on the display 10. The payment processing unit 43 also stores the first image G1 and the common-edge-removed second image I2 relationally to transaction information including the payment date, the magnetic information, and the input information. The payment processing unit 43 also stores and saves the first image G1 and common-edge-removed second image I2, and then sends a print command for printing an endorsement to the check processing device 5.

Check Processing Operation

In the payment process executed at the financial institution to which the check 2 is presented, the check 2 is inserted to the conveyance path 18 of the check processing device 5, and a start processing command is sent from the control device 7 to the check processing device 5.

As a result, the check processing device 5 conveys the check 2 through the conveyance path 18, reads the magnetic ink characters 11 printed on the check 2 with the magnetic sensor 15, and acquires the magnetic information. The check processing device 5 also sends the acquired magnetic information to the control device 7. The check processing device 5 also scans the face 2*a* of the check 2 with the image sensor 16, and sequentially sends the scanned information to the control device 7.

When the scanned information is received from the check processing device 5, the control device 7 acquires the first image G1 (FIG. 3 A) and the second image G2 (FIG. 3B).

The control device 7 also applies the image processing filter to the first image G1 and generates the first edge image H1 (FIG. 4A), and applies the image processing filter to the second image G2 and generates the second edge image H2 (FIG. 4B). The control device 7 then removes the second edges 62 in the second edge image H2 that match the first edges 61 in the first edge image H1 based on the first vector information of the first edge 61 contained in the first edge image H1 and the second edge 62 contained in the second edge image H2, thereby generating the common-edge-removed second image I2 (FIG. 6). The control device 7 then displays the first image G1 and the common-edge-removed second image I2 on the display 10.

The operator then checks the authenticity of the check 2 based on the common-edge-removed second image I2 shown on the display 10. More specifically, the operator inspects the security image 12 that appears in the common-edge-removed second image I2 on the display 10. The operator also checks the payment information based on the first image G1 and the check 2, and inputs the information required to settle payment to the main unit 8 through the input device 9.

When the information required to settle payment is input, the payment process is executed based on the input information and the magnetic information. When payment is completed, the control device 7 relationally stores the first image Gland common-edge-removed second image I2 with transaction information including the payment date, the magnetic information, and the input information. The control device 7 also sends a print command to the check processing device 5 and prints an endorsement on the check 2.

Only the security image 12 (the image printed with UV ink) appears in the common-edge-removed second image I2 in this example. The security image 12 can therefore be easily recognized.

Other Embodiments

In the operation whereby the common-edge-removed second image generating unit 52 generates the common-edge-removed second image I2, pixels in the second edge image H2 that have still not been processed after step ST1 and step ST2 may be removed from the second edge image H2 as being part of a common edge if the cosine similarity C(x, y) of that pixel is greater than or equal to predetermined similarity threshold.

More specifically, a second edge part of a second edge 62 where the strength component (edge strength) of the second vector information is less than or equal to than a first strength threshold may be detected as a common edge part; a second edge part of a second edge 62 where the strength component (edge strength) of the second vector information is less than a first strength threshold, and a first edge part of a first edge 61 where the strength component (edge strength) of the first vector information is greater than or equal to a second strength threshold, may be detected to be common edge parts if the difference between the directional component of the first vector information and the directional component of the second vector information is within a predetermined angle range; and those edge parts can be removed from the second edge image H2.

The similarity threshold in this case is preferably closer to 1 than 0.

Further alternatively, in the operation whereby the common-edge-removed second image generating unit 52 generates the common-edge-removed second image I2, the common-edge-removed second image generating unit 52 may calculate the cosine similarity C(x, y) between each pixel in the second edge image H2 and the corresponding pixel in the first edge image H1, and remove the pixels from the second edge image H2 as being part of a common edge if the cosine similarity C(x, y) is greater than or equal to a predetermined similarity threshold. More specifically, based only on the directional component in the first vector information of a first edge 61 in the first edge image H1, and the directional component in the second vector information of a second edge 62 in the second edge image H2, the first edge part and the second edge part can be detected as common edge parts if the difference between these directional components is within a predetermined angle range, and these edge parts can be removed from the second edge image H2.

The similarity threshold in this case is preferably closer to 1 than 0.

Note that the check processing device 5 may also have a pair of image sensors 16 on opposite sides of the conveyance path 18 at the image reading position B, and acquire images of both the front and back of the check 2.

The check processing device 5 may also be configured to acquire a color image as the first image G1.

An image recognition unit that recognizes text and images from the face 2*a* of the check 2 based on the first image G1 may also be provided.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An image processing device connectable to a check processing device configured to process a check printed by ink including a UV ink readable by an image sensor and a magnetic ink readable by a magnetic sensor, the image processing device comprising: a computer which runs a program configured to acquire a first image from the check processing device that includes a first reflection of a first portion printed by the magnetic ink on a surface of the check exposed to a visible first light, and acquire a second image from the check processing device that includes a second reflection of the first portion printed by the magnetic ink, and fluorescence of a second portion printed by the UV ink on a surface of the check exposed to an ultraviolet second light; apply an edge-extracting image processing filter to the first image and generate a first edge image, and apply the image processing filter to the second image and generate a second edge image; detect common edge parts where a first edge extracted in the first edge image and a second edge extracted in the second edge image are at corresponding positions, removes the common edge parts from the second edge image, and generates a common-edge-removed second image; and show the common-edge-removed second image on a display and execute a payment process based on magnetic information acquired from the check processing device, and wherein the computer is configured to detect the common edge parts based on first vector information of the first edge and second vector information of the second edge, the first vector information comprising a first edge strength and a first direction of the first edge and the second vector information comprising a second edge strength and a second direction of the second edge, wherein the extracted edges of the second portion printed by the UV ink remain in the common-edge removed second image.

2. The image processing device described in claim 1, wherein:

the image processing filter is a Sobel filter.

3. An image processing method that is connectable to a check processing device and is configured to process a check printed by ink including a UV ink readable by an image sensor and a magnetic ink readable by a magnetic sensor, the image processing method comprising: acquiring a first image from the check processing device that includes a first reflection of a first portion printed by the magnetic ink on a surface of the check exposed to a visible first light, and acquiring a second image from the check processing device that includes a second reflection of the first portion printed by the magnetic ink, and fluorescence of a second portion printed by the UV ink on a surface of the check exposed to an ultraviolet second light; generating a first edge image by applying an edge-extracting image processing filter to the first image, and generating a second edge image by applying the image processing filter to the second image; generating a common-edge-removed second image by detecting common edge parts where a first edge extracted in the first edge image and a second edge extracted in the second edge image are at corresponding positions, and removing the common edge parts from the second edge image; and showing the common-edge-removed second image on a display and executing a payment process based on magnetic information acquired from the check processing device, wherein the common edge parts are detected based on first vector information of the first edge and second vector information of the second edge, the first vector information comprising a first edge strength and a first direction of the first edge and the second vector information comprising a second edge strength and a second direction of the second edge, and wherein the extracted edges of the second portion printed by the UV ink remain in the common-edge removed second image.

4. The image processing method described in claim 3, wherein:

the image processing filter is a Sobel filter.

5. A program stored on a non-transitory computer-readable medium connectable to a check processing device that is configured to process a check printed by ink including a UV ink readable by an image sensor and a magnetic ink readable by a magnetic sensor and operates on a control device that controls driving an the image sensor, the program causing the control device to function as: an image acquisition unit that acquires a first image from the check processing device that includes a first reflection of a first portion printed by the magnetic ink on a surface of the check exposed to a visible first light, and acquires a second image from the check processing device that includes a second reflection of the first portion printed by the magnetic ink, and fluorescence of a second portion printed by the UV ink on a surface of the check exposed to an ultraviolet second light; an edge image generating unit that applies an edge-extracting image processing filter to the first image and generates a first edge image, and applies the image processing filter to the second image and generates a second edge image; a common-edge-removed second image generating unit that detects common edge parts where a first edge extracted in the first edge image and a second edge extracted in the second edge image are at corresponding positions, removes the common edge parts from the second edge image, and generates a common-edge-removed second image; and a payment processing unit configured to show the common-edge-removed second image on a display and execute a payment process based on magnetic information acquired from the check processing device, wherein the common edge parts are detected based on first vector information of the first edge and second vector information of the second edge, the first vector information comprising a first edge strength and a first direction of the first edge and the second vector information comprising a second edge strength and a second direction of the second edge, wherein the extracted edges of the second portion printed by the UV ink remain in the common-edge removed second image.

* * * * *